US005555597A

United States Patent [19]

Berfield

[11] Patent Number: 5,555,597

[45] Date of Patent: Sep. 17, 1996

[54] APPARATUS FOR CONVERTING A VACUUM CLEANING DEVICE INTO A LIQUID DISPENSING AND SUCTIONING SYSTEM

[75] Inventor: Robert C. Berfield, Jersey Shore, Pa.

[73] Assignee: Shop Vac Corporation, Williamsport, Pa.

[21] Appl. No.: 366,037

[22] Filed: Dec. 29, 1994

[51] Int. Cl.[6] ..... A47L 7/00

[52] U.S. Cl. ..... 15/321; 15/328; 15/353

[58] Field of Search ..... 15/328, 321, 353

[56] References Cited

U.S. PATENT DOCUMENTS

| | | | |
|---|---|---|---|
| 965,315 | 7/1910 | Moorhead . | |
| 1,461,947 | 7/1923 | Sporer . | |
| 1,592,882 | 7/1926 | Artas . | |
| 1,661,480 | 3/1928 | Keefer . | |
| 1,783,506 | 12/1930 | Homiller . | |
| 1,982,345 | 11/1934 | Kirby . | |
| 2,270,579 | 1/1942 | Chamberlin et al. | 15/4 |
| 2,436,454 | 2/1948 | Sensenbach et al. . | |
| 2,718,656 | 9/1955 | Kirk | 15/320 |
| 2,753,578 | 7/1956 | Lebet . | |
| 2,757,406 | 8/1956 | Decker | 15/321 |
| 2,909,800 | 10/1959 | Grindle et al. | 15/321 |
| 3,069,717 | 12/1962 | Cote . | |
| 3,079,285 | 2/1963 | Rockwell | 134/10 |
| 3,114,927 | 12/1963 | Ballantyne . | |
| 3,118,165 | 1/1964 | Meyerhoefer | 15/402 |
| 3,126,573 | 3/1964 | Vosbikian et al. . | |
| 3,355,762 | 12/1967 | Cavell et al. | 15/321 |
| 3,496,592 | 2/1970 | Jones | 15/321 |
| 3,584,330 | 6/1971 | Wallin et al. | 15/375 |
| 3,584,965 | 6/1971 | Chastanler | 401/2 |
| 3,604,049 | 3/1971 | Hetman | 15/302 |
| 3,720,977 | 3/1973 | Brycki | 15/321 |
| 3,818,537 | 6/1974 | Evans | 15/321 |
| 3,909,197 | 9/1975 | Cremers | 8/158 |
| 3,939,515 | 2/1976 | Platek | 15/321 |
| 3,939,527 | 2/1976 | Jones | 15/353 |
| 3,942,217 | 3/1976 | Bates | 15/321 |
| 3,977,797 | 8/1976 | Paterson | 401/15 |
| 4,114,229 | 9/1978 | Jones et al. | 15/320 |
| 4,123,818 | 11/1978 | Hurwitz | 15/321 |
| 4,138,760 | 2/1979 | Cadle | 15/321 |
| 4,153,968 | 5/1979 | Perkins | 15/321 |
| 4,164,055 | 8/1979 | Townsend | 15/321 |
| 4,176,421 | 12/1979 | Baird | 15/320 |
| 4,185,354 | 1/1980 | Brazier | 15/321 |
| 4,216,563 | 8/1980 | Cyphert | 15/328 X |
| 4,218,805 | 8/1980 | Brazier | 15/321 |
| 4,226,000 | 10/1980 | Tribolet | 15/321 |
| 4,238,869 | 12/1980 | Lachance | 15/353 |
| 4,273,459 | 6/1981 | Hardy | 401/139 |
| 4,287,636 | 9/1981 | Brazier | 15/321 |
| 4,314,385 | 2/1982 | Wimsatt et al. | 15/328 X |
| 4,318,202 | 3/1982 | Holman | 15/328 |
| 4,329,756 | 5/1982 | Chicoine et al. | 15/321 |
| 4,333,203 | 6/1982 | Yonkers | 15/321 |
| 4,353,145 | 10/1982 | Woodford | 15/321 |
| 4,397,057 | 8/1983 | Harbeck | 15/321 |
| 4,458,377 | 7/1984 | Frohbieter | 15/328 X |
| 4,485,518 | 12/1984 | Kasper | 15/322 |
| 4,531,257 | 7/1985 | Passien | 15/321 |
| 4,534,083 | 8/1985 | Hampson | 15/321 |

(List continued on next page.)

FOREIGN PATENT DOCUMENTS

| | | |
|---|---|---|
| 0176696 | 4/1986 | European Pat. Off. . |
| 0343129 | 11/1989 | European Pat. Off. . |
| 2428429 | 1/1980 | France . |
| 2611480 | 9/1988 | France . |

*Primary Examiner*—Chris K. Moore

*Attorney, Agent, or Firm*—Marshall, O'Toole, Gerstein, Murray & Borun

[57] ABSTRACT

An apparatus for converting a vacuum cleaning apparatus having a first tank, a hose inlet and a suction source coupled to the hose inlet into a liquid dispensing and suctioning system includes a liquid holding tank for holding liquid, an attachment head having an outlet for dispensing liquid and an inlet for suctioning liquid, a housing attachable to the hose inlet and means including a pump disposed in the housing and coupled to the holding tank for delivering liquid from the holding tank to the outlet of the head.

15 Claims, 8 Drawing Sheets

U.S. PATENT DOCUMENTS

| | | | |
|---|---|---|---|
| 4,557,013 | 12/1985 | Belmont | 15/401 |
| 4,597,124 | 7/1986 | Williams, III et al. | 8/158 |
| 4,654,926 | 4/1987 | McCambridge . | |
| 4,670,062 | 6/1987 | Lester | 134/21 |
| 4,776,058 | 10/1988 | Garner et al. | 15/320 |
| 4,776,716 | 10/1988 | Huang | 401/139 |
| 4,788,738 | 12/1988 | Monson et al. | 15/320 |
| 4,801,376 | 1/1989 | Kulitz | 210/123 |
| 4,809,396 | 3/1989 | Houser | 15/320 |
| 4,825,496 | 5/1989 | Taylor | 15/24 |
| 4,845,802 | 7/1989 | Miller et al. | 15/321 |
| 4,864,681 | 9/1989 | Hult et al. | 15/367 |
| 4,887,330 | 12/1989 | Woodhall et al. | 15/322 |
| 4,899,418 | 2/1990 | Steiner et al. | 15/344 |
| 4,934,017 | 6/1990 | Kent | 15/321 |
| 4,954,001 | 9/1990 | Billat | 401/139 |
| 4,955,104 | 9/1990 | Miller | 15/322 |
| 4,961,246 | 10/1990 | Hauge et al. | 15/401 |
| 4,984,328 | 1/1991 | Berfield | 15/322 |
| 5,001,806 | 3/1991 | Gurstein | 15/322 |
| 5,060,342 | 10/1991 | Brazier | 15/322 |
| 5,067,199 | 11/1991 | Alazet | 15/320 |
| 5,103,526 | 4/1992 | Berfield | 15/322 |
| 5,189,755 | 3/1993 | Yonkers et al. | 15/321 |
| 5,210,902 | 5/1993 | Lee et al. | 15/321 |
| 5,263,224 | 11/1993 | Lovelady | 15/353 |
| 5,280,666 | 1/1994 | Wood et al. | 15/401 |
| 5,287,587 | 2/1994 | Yonkers et al. | 15/320 |
| 5,287,588 | 2/1994 | Gurstein et al. | 15/321 |
| 5,289,611 | 3/1994 | Yonkers et al. | 15/321 |
| 5,341,541 | 8/1994 | Sham | 15/320 |
| 5,364,198 | 11/1994 | Skenderi | 401/138 |
| 5,367,740 | 11/1994 | McCray | 15/320 |
| 5,377,382 | 1/1995 | Bores et al. | 15/340 |
| 5,386,612 | 2/1995 | Sham | 15/320 |

APPARATUS FOR CONVERTING A VACUUM CLEANING DEVICE INTO A LIQUID DISPENSING AND SUCTIONING SYSTEM

FIELD OF THE INVENTION

The present invention relates generally to cleaning apparatus, and more particularly to an apparatus for converting a vacuum cleaning apparatus, such as a wet/dry vacuum, into a liquid dispensing and suctioning system for surface cleaning.

BACKGROUND OF THE INVENTION

Vacuum cleaning apparatus, such as wet/dry vacuums, are well known, as are liquid extraction cleaning systems. The latter systems dispense a cleaning solution onto a carpet or the like and then apply a suction force to the carpet to extract the soiled liquid therefrom.

Though a wet/dry vacuum could be used to pick up soiled liquid, such a vacuum does not have the liquid dispensing capabilities needed for cleaning. Therefore, most customers are forced to own and/or rent both a wet/dry vacuum and a liquid extraction cleaning system. This obviously is expensive and requires more storage space for the two systems if the customer owns both.

Though there have been attempts to provide an apparatus to convert a wet/dry vacuum into a liquid extraction cleaning system, these attempts appear to be complicated, cumbersome and/or expensive.

SUMMARY OF THE INVENTION

The present invention provides an apparatus for converting a variety of different vacuum cleaning devices into liquid dispensing and suctioning systems.

More particularly, in accordance with one aspect of the present invention, an apparatus for converting a vacuum cleaning apparatus having a first tank, a hose inlet and a suction source coupled to the hose inlet into a liquid dispensing and suctioning system includes a liquid holding tank for holding liquid, an attachment head having an outlet for dispensing liquid and an inlet for suctioning liquid, a housing attachable to the hose inlet and means including a pump disposed in the housing and coupled to the holding tank for delivering liquid from the holding tank to the outlet of the head.

In accordance with a preferred form of the present invention, the delivering means includes means extending through the housing for coupling the suction source to the inlet of the attachment head to apply a suction force to a surface to be cleaned. The delivery means may also include means disposed in the housing for actuating the suction source.

Also in accordance with the preferred embodiment, the apparatus further includes means disposed between the housing and the attachment head, preferably in the form of a valve, for controlling delivery of the liquid from the holding tank to the outlet of the attachment head. The valve includes relatively movable valve members and a trigger operable to move the valve members and thereby open the valve.

Still further in accordance with the preferred embodiment, the pump is of the recirculating type, the liquid holding tank is disposed within the first tank and the vacuum cleaning apparatus is a wet/dry vacuum cleaner.

In accordance with a further aspect of the present invention, an apparatus for converting a suctioning system having a first tank, a hose inlet and a suction source into a liquid dispensing and suctioning system includes a liquid holding tank disposed within the first tank for holding liquid and an attachment head having an outlet for dispensing the liquid and an inlet for suctioning the liquid. A housing is coupled to the hose inlet and a pump is disposed in the housing. Fluid conduits are coupled between the liquid holding tank and the pump and between the pump and the attachment head. An enclosed air passage is coupled between the attachment head and the suction source and extends through the housing.

Other features and advantages are inherent in the apparatus claimed and disclosed or will become apparent to those skilled in the art from the following detailed description in conjunction with the accompanying drawings.

DETAILED DESCRIPTION OF THE INVENTION

Figure 1:
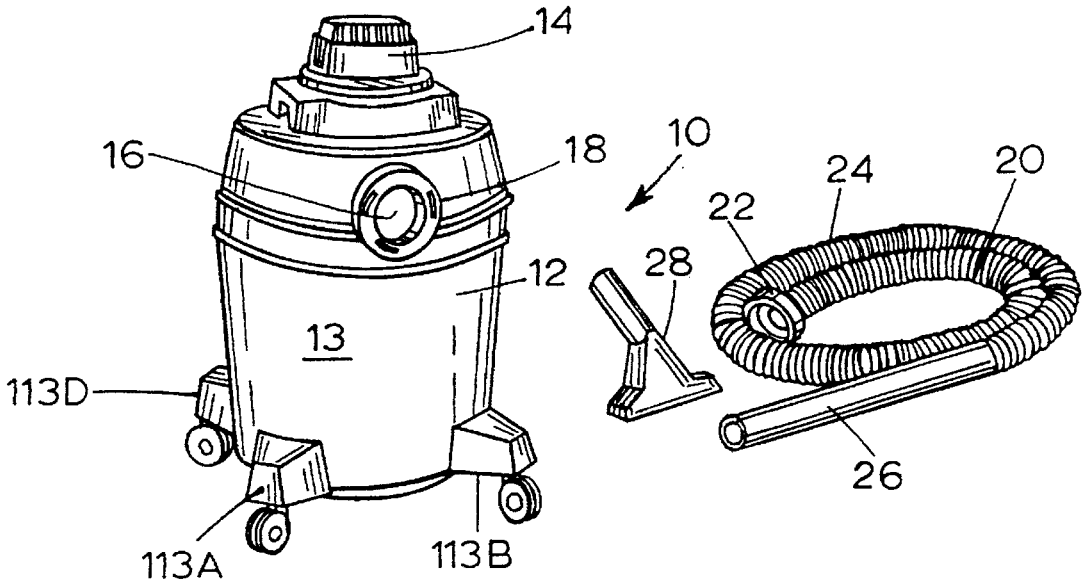
FIG. 1 is a perspective view of a vacuum cleaning apparatus partially disassembled.
Figure 3:
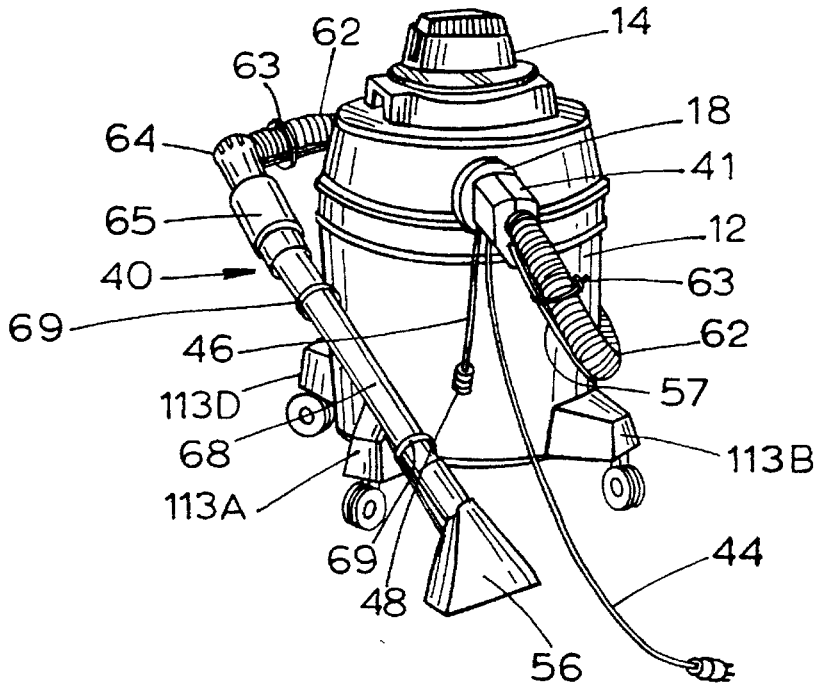
FIG. 3 is a perspective view of an apparatus which has been converted from a vacuum cleaning apparatus into a suctioning and dispensing system.

As seen in FIG. 1, a conventional vacuum cleaning apparatus, such as a wet/dry vacuum 10 capable of wet/dry pickup, includes a wet/dry material collecting tank 12 having an external wall 13 and a head 14 which contains an electric motor and impeller (not shown) for creating suction. The wet/dry vacuum 10 further includes an inlet 16 to the tank 12 and an intake fitting 18 surrounding the inlet 16. A hose 20 having a fitting 22 at a first end 24 detachably engages the intake fitting 18, preferably with an interference fit, to provide a secure connection between the hose 20 and the head 14 during use. A second end 26 of the hose 20 is connectable via an interference fit or other conventional connection means to an accessory, such as a nozzle 28 having an inlet opening. During use, the inlet of the nozzle 28 is applied to a surface and a vacuum is drawn through the hose 20 and the nozzle 28 to remove solid debris and/or liquid from the surface and to deposit same into the tank 12.

FIGS. 2–9 illustrate a conversion assembly 40 which converts the wet/dry vacuum 10 from a vacuum cleaning apparatus to a liquid dispensing and suctioning system.

Figure 6:
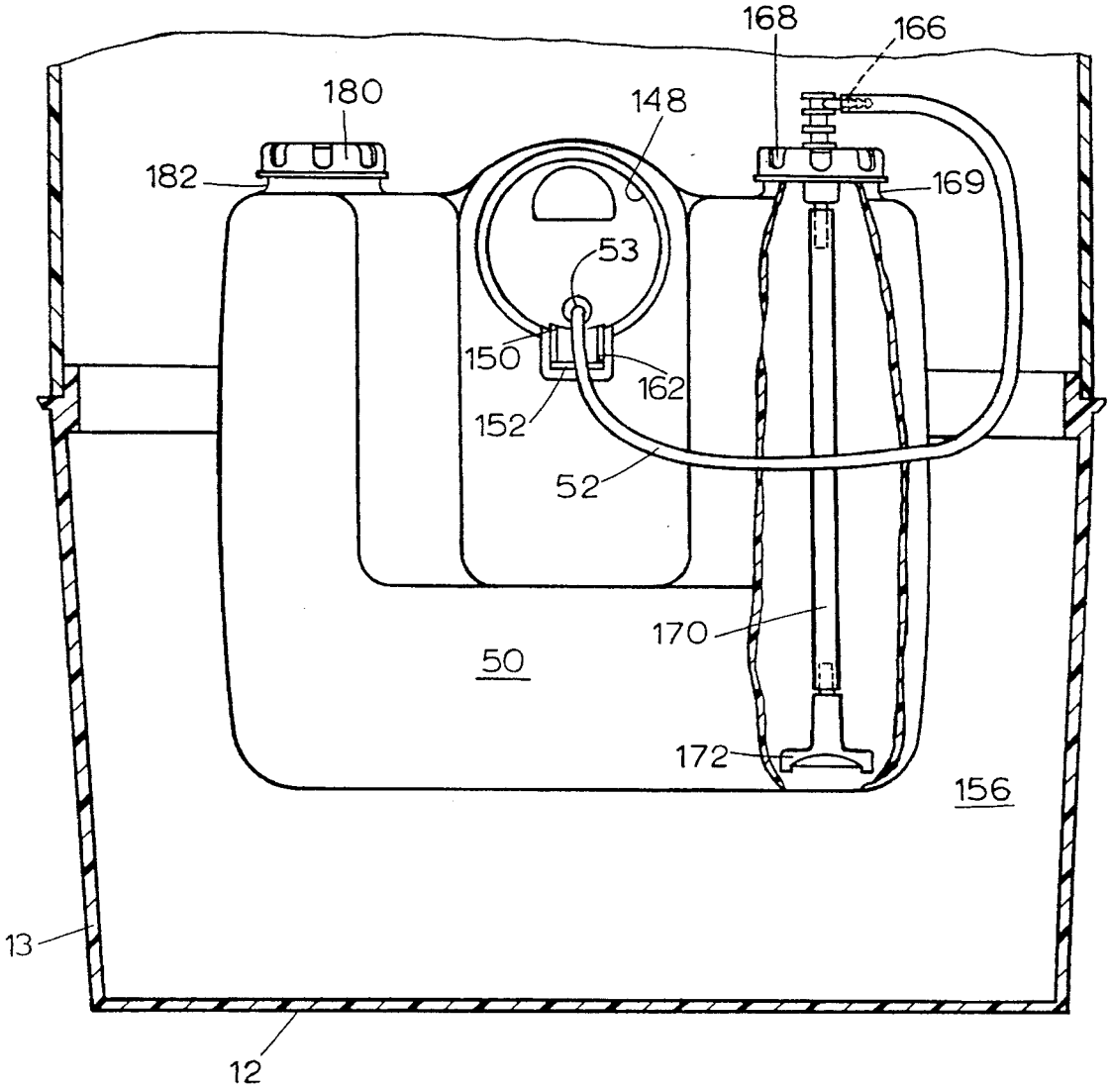
FIG. 6 is a side sectional view of the liquid holding tank taken generally along the lines 6—6 of FIG. 5.
Figure 7:
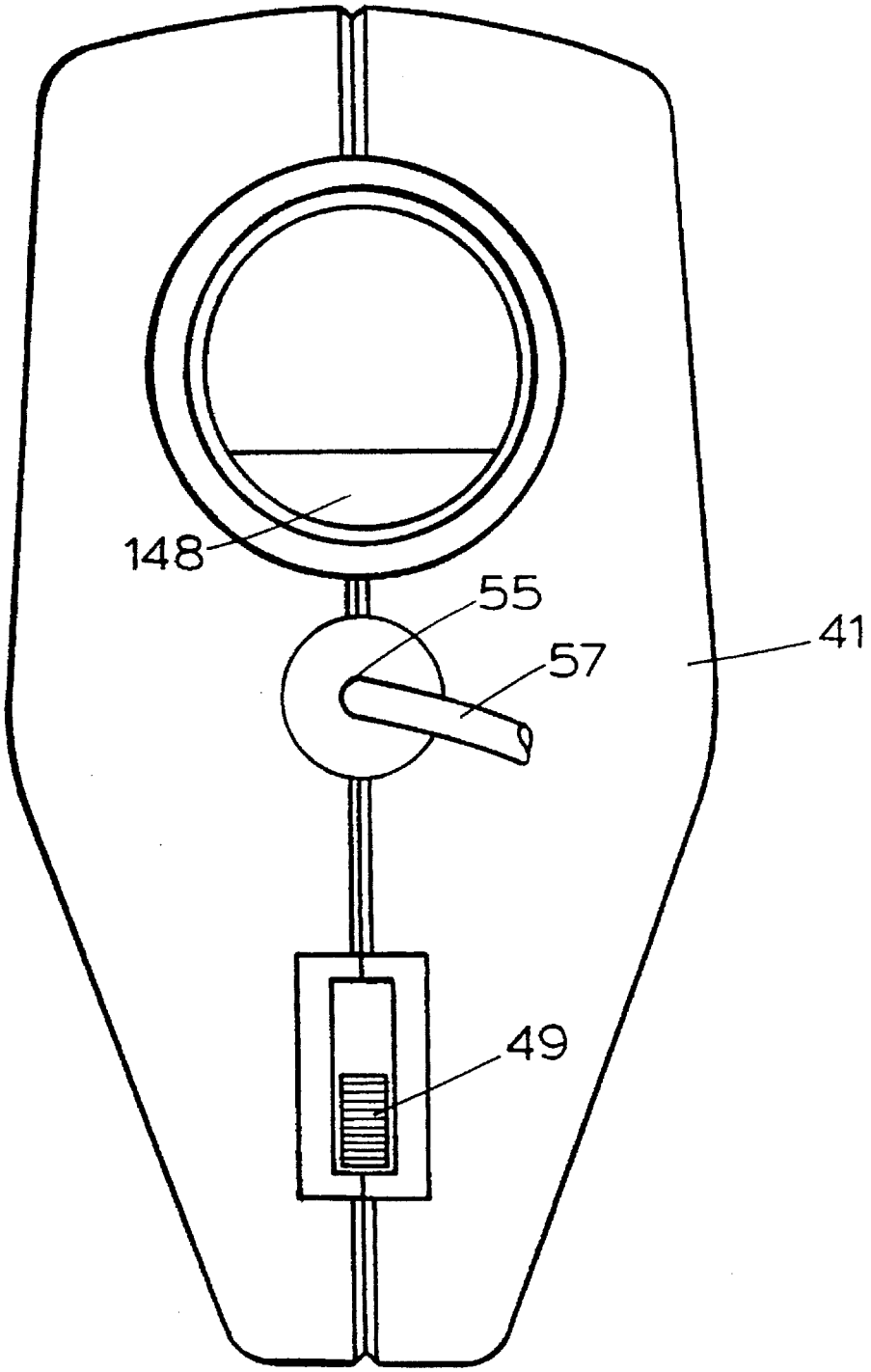
FIG. 7 is a fragmentary front elevational view of the pump of FIG. 3.

Referring first to FIGS. 2–6, the conversion assembly 40 includes a pump housing 41 having a connection collar 42, similar to the fitting 22, which is preferably, although not necessarily connected by a friction fit or other connection to the intake fitting 18 of the wet/dry vacuum 10. Disposed in the housing 41 is an electrically actuated pump 43 (FIG. 4), which may be of the recirculating type. A power cord 44 is included for connection to an electrical power source together with a receptacle cord 46 having a female receptacle 48 into which a power cord of the wet/dry vacuum 10 may be plugged. Alternatively the female receptacle 48 may be disposed on a wall of the housing 41 thereby eliminating the need for the cord 46. Referring also to FIG. 7, a power switch 49 is provided which is actuable to couple electrical power from the power source to the pump and the female receptacle 48.

The assembly 40 also includes a liquid holding tank 50 for holding a liquid such as a carpet cleaning solution. According to a first embodiment, the liquid holding tank 50 may be sized and shaped to fit within the tank 12, as noted in greater detail hereinafter. Means are also provided for delivering the liquid in the holding tank 50 to a surface to be cleaned including a flexible conduit or tube 52 coupled between the holding tank 50 and an inlet 53 of the pump (FIG. 6). The delivering means further includes a conduit system 54 which extends between an outlet 55 of the pump (FIG. 7) and an attachment head 56. Such an attachment head 56 may be similar to or identical to that disclosed in Berfield U.S. Pat. No. 4,984,328, the disclosure of which is incorporated herein by reference. Alternatively, the attachment head 56 may be of any conventional attachment design, as desired.

Figure 2:
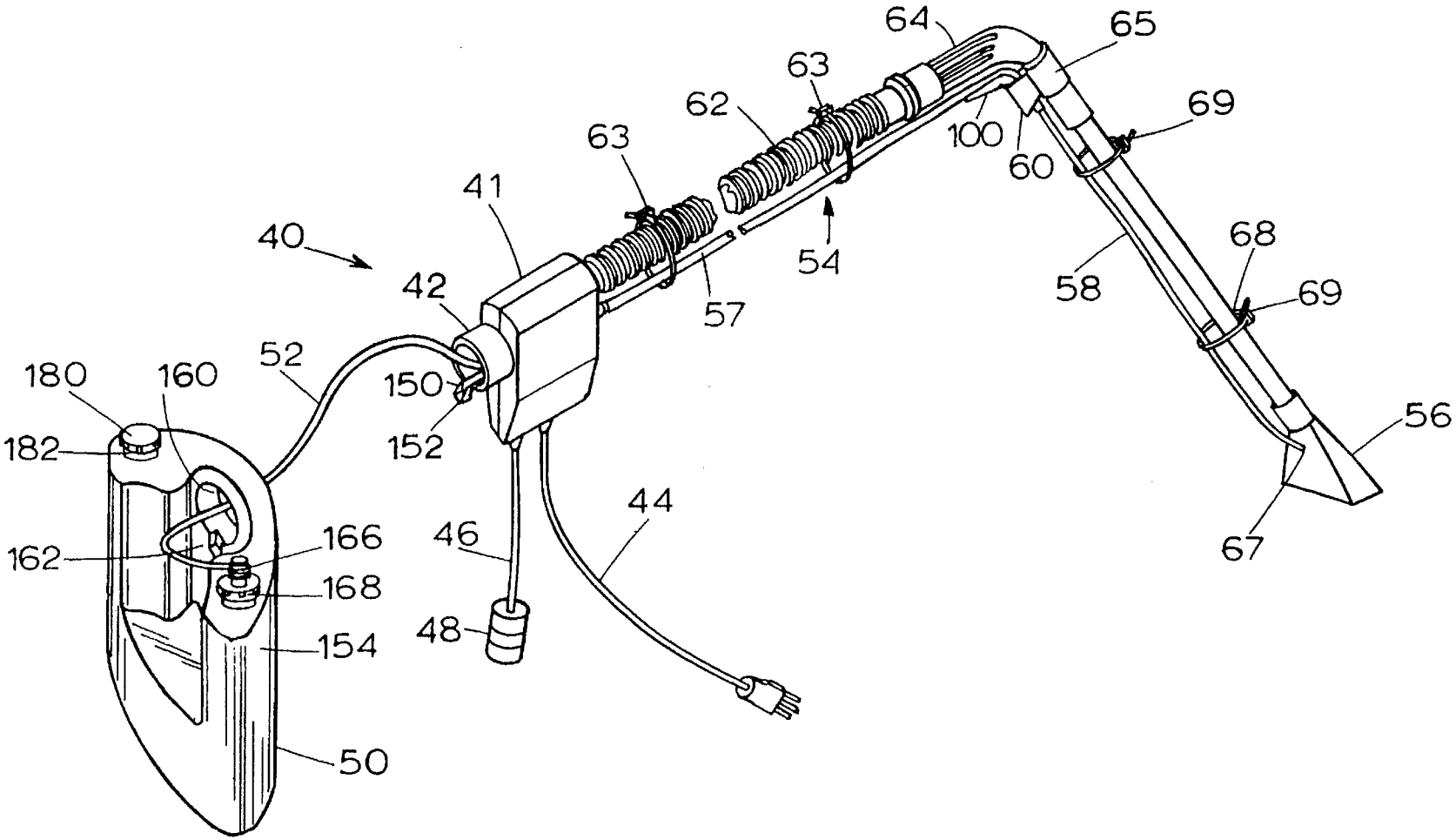
FIG. 2 is a perspective view of an apparatus used to convert the vacuum cleaning apparatus of FIG. 1 into a suctioning and dispensing system.

The conduit system 54 includes a second conduit 57, a third conduit 58 and a control valve 60 disposed in fluid communication between the second and third conduits 57, 58. The second and third conduits 57, 58 are preferably constructed of a flexible material. As seen specifically in FIGS. 2, 4, and 7–9, the second conduit 57 is connected between the pump outlet 55 and an inlet port 61 of the control valve 60. The second conduit 57 is preferably, although not necessarily, secured in any convenient manner, such as by plastic ties 63 to the exterior of a suction hose 62, which is similar to the hose 20. The suction hose 62 is connected at a first end to the housing 41 and at a second end to a hose end fitting 64. As seen specifically in FIGS. 8 and 9 and as described in greater detail hereinafter, the control valve 60 is disposed in a valve housing 65 secured to the hose end fitting 64. The third conduit 58 is coupled between an outlet port 66 of the control valve 60 and an inlet 67 of the attachment head 56 (FIG. 2). The third conduit 58 is preferably, although not necessarily, secured by plastic ties 69 or any other suitable means to an extender tube 68 coupled between the trigger housing 65 and the attachment head 56.

Figure 8:
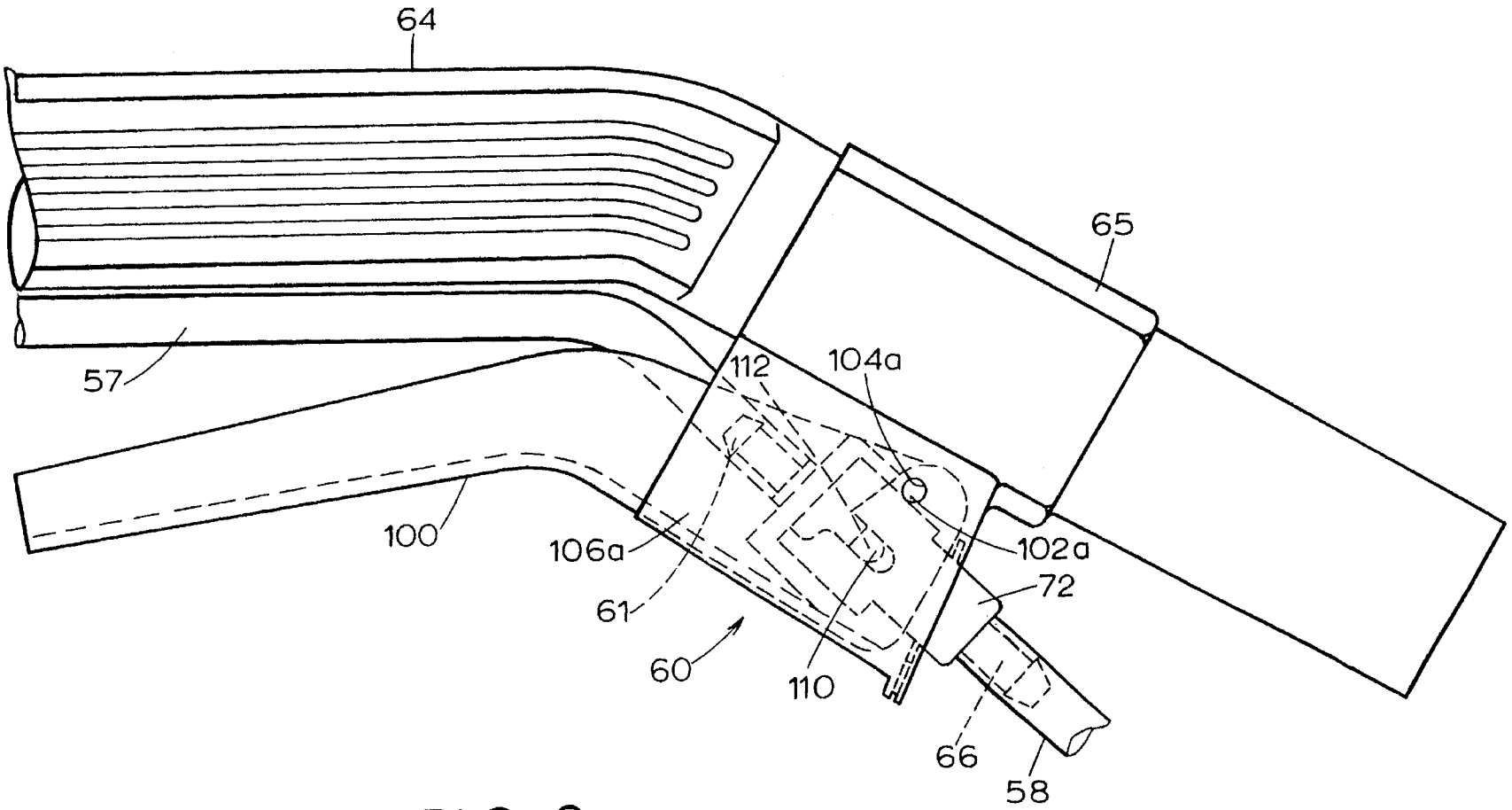
FIG. 8 is a fragmentary side elevational view, partially in phantom, of the hose coupler and valve of Figs. 2 and 3.
Figure 9:
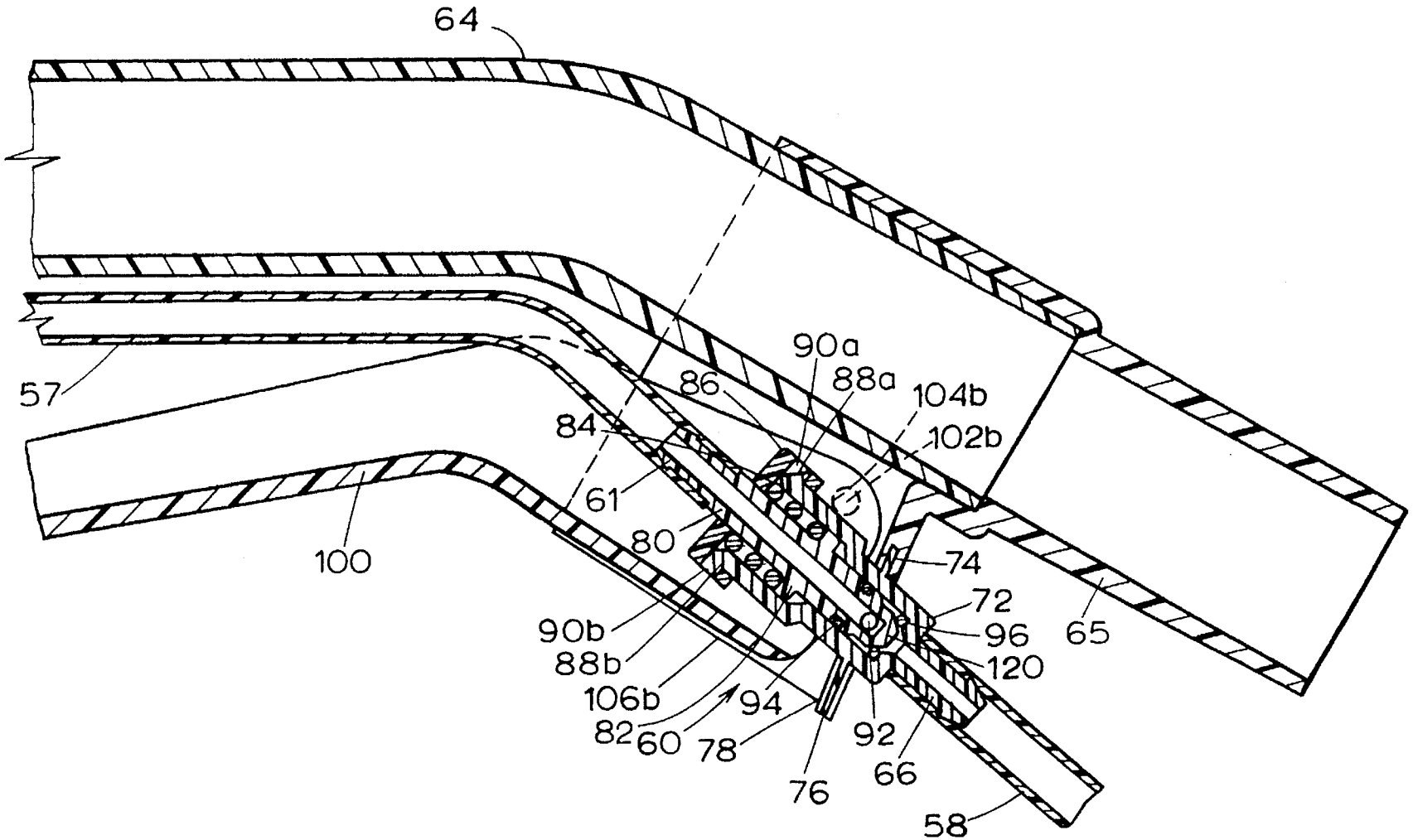
FIG. 9 is a full sectional view of the control valve of FIG. 8.

As best seen in FIGS. 8 and 9, the control valve 60 includes a valve body 72 having a circumferential flange 74 which is received within a groove 76 formed in a downwardly depending member 78 of the trigger housing 65. The valve body 72 carries the outlet port 66 to which the tube 58 is attached. The valve body 72 is hollow and receives therein a valve piston 80 having an end at which the inlet port 61 is located. The valve piston 80 further includes a circumferential flange 82 forming one stop for a spring 84. A second stop for the spring 84 is provided by a valve spring holder 86 which is held in place on the end of the valve body 72 by engagement of hooked portions 88*a*, 88*b* within walls defining recesses 90*a*, 90*b*, respectively.

The valve piston 80 is hollow and includes a pair of escape ports 92 (only one of which is visible in FIG. 9) which allow fluid communication between the hollow interior of the valve piston 80 and the hollow interior of the valve body 72. First and second 0-rings 94, 96 prevent fluid carried in the tube 57 from escaping into the tube 58 when the valve is in the position shown in FIG. 9 and further prevent fluid from entering the portion of the valve body containing the spring 84.

A trigger 100 includes first and second tabs or dogs 102*a*, 102*b* which are received in bores 104*a*, 104*b* formed in sidewall portions 106*a*, 106*b*, respectively of the trigger housing 65. The trigger 100 is movable between a first or downward position, as seen in FIGS. 8 and 9, and a second or upper position. The trigger 100 further includes first and second substantially semi-circular openings 110 (only one of which is visible in FIG. 8) each of which receives a similarly shaped tab 112 carried by the valve piston 80.

To dispense fluid from the holding tank 50 to a surface to be cleaned, the pump is activated and the valve 60 is opened by pivoting the trigger 100 upwardly from the lower position shown in FIGS. 8 and 9 to the upper position. The pivoting action of the trigger causes the tabs 112, and thus the valve piston 80, to be moved to the left as seen in FIGS. 8 and 9. The recapturing of the flange 74 of the valve body 72 in the slot 76 prevents movement of the valve body 72 during such pivoting. As a result, relative movement occurs between the valve piston 80 and the valve body 72 so that a nose portion 120 of the valve piston 80 is spaced from the 0-ring 96. This spacing permits cleaning fluid to pass through the escape port 92 into the interior of the valve body 72 past the nose portion 120 and the 0-ring 96 into the outlet port 66 and the tube 58. The cleaning fluid then flows to the attachment head 56, where it is dispensed through an outlet thereof.

When further fluid flow is to be terminated, the trigger 100 is released and is returned to the position shown in FIGS. 8 and 9 under the influence of the spring 84. The nose portion 120 of the valve piston 80 thus returns to the position shown in FIG. 9 to seal against the 0-ring 96 and prevent further flow of fluid therepast.

Figure 4:
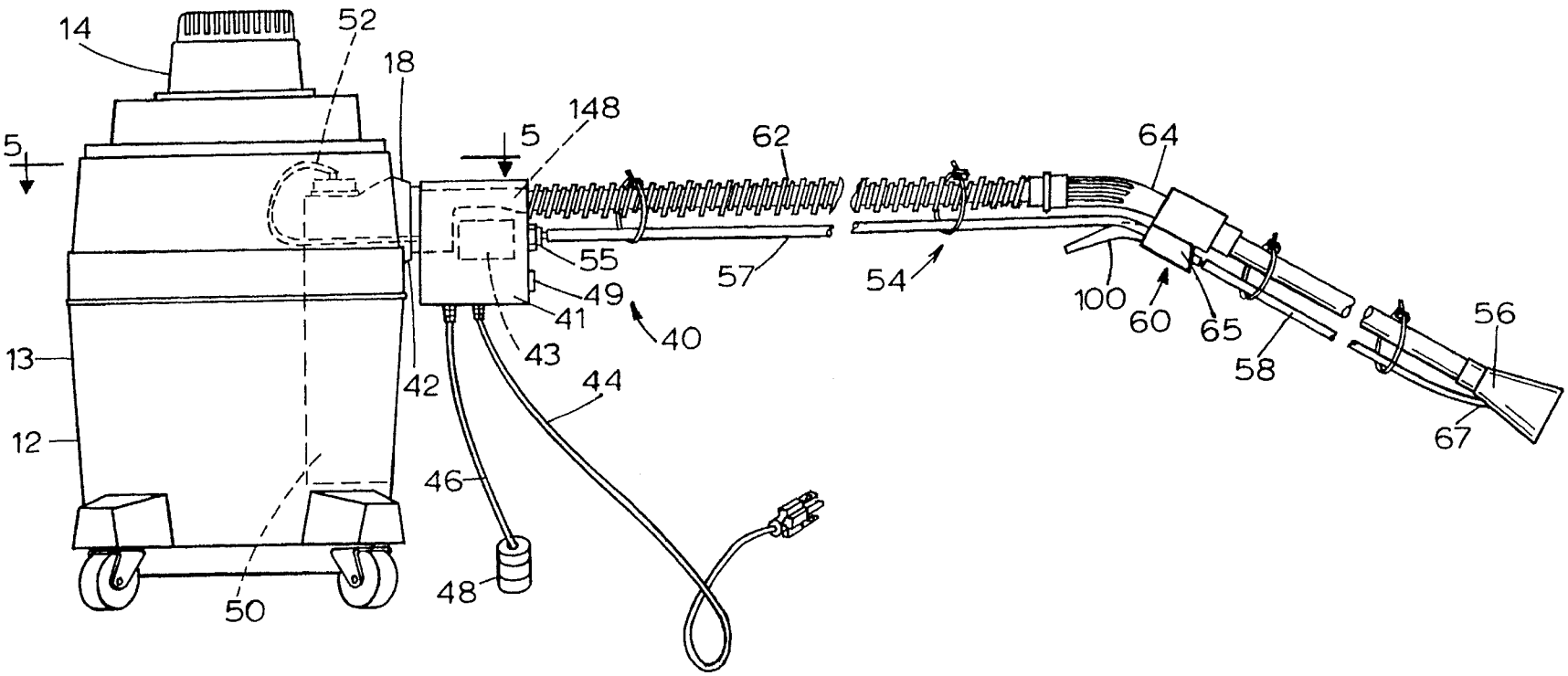
FIG. 4 is an elevational view, partially in phantom, of the suctioning and dispensing system of FIG. 3.
Figure 5:
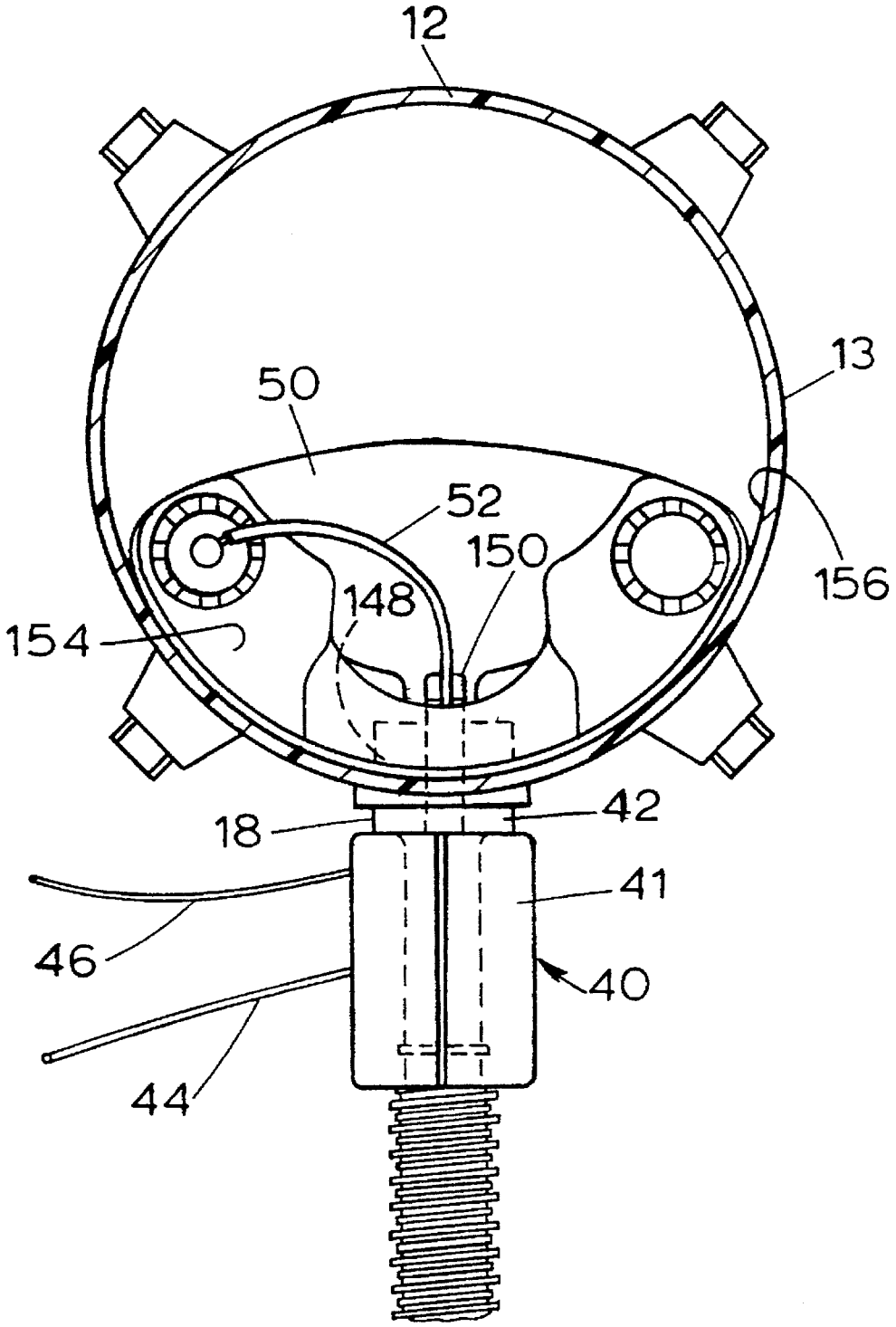
FIG. 5 is a sectional view of the suctioning and dispensing system taken generally along the lines 5—5 of Fig.

After the liquid is dispensed onto the surface to be cleaned, liquid and soil are drawn into a suction inlet of the attachment head 54 by the suction created by the motor in the head 14. The liquid and soil are then drawn through the enclosed air passage formed by the attachment head 56, the extender tube 68, the valve housing 65, the hose end fitting 64, the suction hose 62, a hose end member disposed 148 in the pump housing 41 as seen in FIG. 4, (wherein an end of the hose end member 148 forms the connection collar 42 mentioned previously) and the inlet 16 into the tank 12.

As seen in FIGS. 2–6, the hose end member 148 includes an outwardly extending tongue 150 having a downwardly projecting tab or member 152 on an end thereof. When the conversion assembly 40 is initially mounted on the wet/dry vacuum 10, the tank 50 is placed within the tank 12 such that an outer substantially circular surface 154 of the tank 50 is placed closely adjacent an inner surface 156 of the tank 12. The hose 52 is then passed through the inlet 16 and the connection collar 42 is inserted into the opening 16 and through a further opening 160 in the tank 50. The downwardly depending tab or member 152 rides up and over the surfaces defining the inlet 16 and the opening 160 and into a recess or notch 162 formed in a bottom portion of the walls defining the opening 160. The wall 13 of the tank 12 is thus captured between the tank 50 and the pump housing 41 so that these various items are restrained against further relative movement. The hose 52 may be secured to a fitting 166 carried by a cap 168 which is threaded onto a threaded collar 169 of the tank 50. A downwardly extending tube 170 and pickup fitting 172 are in fluid communication with the fitting 166 and permit fluid communication between the fitting 166 and the interior of the tank 50.

Preferably, although not necessarily, the surfaces 154 and 156 are substantially complementary in shape. More specifically, the tank 50 is intended for use in tanks 12 of various diameters and heights, so that the conversion assembly 40 can be used with wet/dry vacuums of different capacities. Because of this, the surface 154 preferably has a shape which provides a substantially exact fit with the smallest capacity tank 12 with which the assembly 40 is intended to be used. The surface 154 will then not be exactly complementary with larger tanks, but will provide an acceptable fit therewith.

A separate fill cap 180 may be provided on the tank 50 which is threaded onto an upstanding collar 182. The cap 180 may be removed to permit filling of the tank 50 as necessary.

It should be noted that other configurations for the tank 50 could alternatively be used and/or the tank may be provided on the outside of the tank 12 rather than on the inside thereof, as desired. Further, the hoses 52, 57 and 58 may be replaced by other flexible or rigid conduits, as desired, and the valve 60 may be replaced by a different valve, for example, one which simply pinches a flexible tube shut when no cleaning fluid is to be dispensed.

In the preferred embodiment, the pump 43 is continuously operated but develops only limited pressures and hence fluid flow is terminated when the valve 60 is closed. Alternatively, the pump 43 may be of the recirculating type which is continuously actuated and which operates in a bypass mode when the valve 60 is closed. As a further alternative, an electrical switch may be associated with the valve 60 and may be operable when the trigger 100 is moved upwardly to the second position so that the pump 43 is only turned on when fluid is to be dispensed.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. Apparatus for converting a vacuum cleaning apparatus having a first tank, a hose inlet and a suction source coupled to the hose inlet into a liquid dispensing and suctioning system, comprising:

a liquid holding tank for holding liquid;

an attachment head having an outlet for dispensing liquid and an inlet for suctioning liquid;

a housing attachable to the hose inlet and supported by the vacuum cleaning apparatus, further having means extending through the housing for coupling the suction source to the inlet of the attachment head to apply a suction force to a surface to be cleaned; and means including a pump disposed in the housing and coupled to the holding tank for delivering liquid from the holding tank to the outlet of the head.

2. The conversion apparatus of claim 1, further including means disposed in the housing for actuating the suction source.

3. The conversion apparatus of claim 1, further including means disposed between the housing and the attachment head for controlling delivery of liquid from the holding tank to the outlet of the attachment head.

4. The conversion apparatus of claim 3 wherein the controlling means comprises a valve.

5. The conversion apparatus of claim 4 wherein the valve includes relatively movable valve members and a trigger operable to move the valve members and thereby open the valve.

6. The conversion apparatus of claim 1, wherein the pump is a recirculating pump.

7. The conversion apparatus of claim 1, wherein the liquid holding tank is disposed within the first tank.

8. The apparatus of claim 7, wherein the first tank has an inside surface and wherein the liquid holding tank includes an outside surface substantially conforming to the inside surface.

9. The apparatus of claim 1, wherein the vacuum cleaning apparatus is a wet/dry vacuum cleaner.

10. Apparatus for converting a vacuum cleaning apparatus having a first tank, a hose inlet and a suction source into a liquid dispensing and suctioning system, comprising:

a liquid holding tank disposed within the first tank for holding liquid;

an attachment head having an outlet for dispensing the liquid and an inlet for suctioning the liquid;

a housing coupled to the hose inlet;

a pump disposed in the housing;

fluid conduits coupled between the liquid holding tank and the pump, and between the pump and the attachment head; and an enclosed air passage coupled between the attachment head and the suction source and extending through the housing.

11. The conversion apparatus of claim 10, further including a control valve for controlling fluid flow between the liquid holding tank and the attachment head.

12. The conversion apparatus of claim 11, wherein the control valve includes a first valve member in fluid communication with the attachment head and a second valve member relatively movable with respect to the first valve member and disposed in fluid communication with the pump.

13. The conversion apparatus of claim 12, wherein the control valve further includes a trigger coupled to the first valve member and pivotable to move the first valve member relative to the second valve member and thereby open the control valve.

14. The conversion apparatus of claim 13, wherein the pump is of the recirculating type.

15. The conversion apparatus of claim 13, wherein the vacuum cleaning apparatus is a wet/dry vacuum.

* * * * *